US012313288B2

(12) United States Patent
Hwang et al.

(10) Patent No.: US 12,313,288 B2
(45) Date of Patent: May 27, 2025

(54) AIR CONDITIONER

(71) Applicant: LG Electronics Inc., Seoul (KR)

(72) Inventors: Junho Hwang, Seoul (KR); Beomsoo Seo, Seoul (KR); Youngheon Kwon, Seoul (KR); Joonshik Yoon, Seoul (KR); Pilhyun Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 17/909,267

(22) PCT Filed: Dec. 10, 2020

(86) PCT No.: PCT/KR2020/018044

§ 371 (c)(1),
(2) Date: Sep. 2, 2022

(87) PCT Pub. No.: WO2021/177559

PCT Pub. Date: Sep. 10, 2021

(65) Prior Publication Data

US 2023/0092050 A1 Mar. 23, 2023

(30) Foreign Application Priority Data

Mar. 4, 2020 (KR) ..... 10-2020-0027361

(51) Int. Cl.
*F24F 3/06* (2006.01)
*F24F 3/14* (2006.01)
(Continued)

(52) U.S. Cl.
CPC ..... *F24F 3/065* (2013.01); *F24F 3/1411* (2013.01); *F24F 11/61* (2018.01); *F24F 11/74* (2018.01);
(Continued)

(58) Field of Classification Search
CPC ... F25B 13/00; F25B 49/02; F24F 3/06; F24F 3/14; F24F 3/1429; F24F 3/1411;
(Continued)

(56) References Cited

U.S. PATENT DOCUMENTS 6,467,284 B1 * 10/2002 Chen ..... F25B 43/006 62/324.1
2016/0146479 A1 * 5/2016 Fujita ..... F24F 3/1411 62/271
(Continued)

FOREIGN PATENT DOCUMENTS

JP H11-337116 A 12/1999
JP 2015048982 3/2015
(Continued)

OTHER PUBLICATIONS

Office Action in Korean Appln. No. 10-2020-0027361, mailed on Dec. 9, 2024, 25 pages.

*Primary Examiner* — Harry E Arant
(74) *Attorney, Agent, or Firm* — Fish & Richardson P.C.

(57) ABSTRACT

An air conditioner includes an outdoor unit, a first indoor unit having a first indoor heat exchanger connected to the outdoor unit, a first intake duct connected to an inlet opening of the first indoor unit, a first air supply duct guiding air discharged from an outlet opening of the first indoor unit to indoor room, a second indoor unit having a second indoor heat exchanger connected to the outdoor unit, a second intake duct connected to an inlet opening of the second indoor unit and a second air supply duct guiding air discharged from an outlet of the second indoor unit to indoor room. The first indoor heat exchanger and the second indoor heat exchanger include a moisture absorption layer.

19 Claims, 7 Drawing Sheets

(51) Int. Cl.
*F24F 11/61* (2018.01)
*F24F 11/74* (2018.01)
*F24F 11/84* (2018.01)

(52) U.S. Cl.
CPC ..... *F24F 11/84* (2018.01); *F24F 2203/028* (2013.01); *F24F 2221/34* (2013.01)

(58) Field of Classification Search
CPC .. F24F 11/30; F24F 11/84; F24F 11/74; F24F 11/61; F24F 3/065; F24F 2203/026; F24F 2221/34; F24F 2203/028; F24F 2203/1064
See application file for complete search history.

(56) References Cited

U.S. PATENT DOCUMENTS

| | | | | |
|---|---|---|---|---|
| 2016/0363357 | A1* | 12/2016 | Yamamoto | F25B 13/00 |
| 2017/0158019 | A1 | 6/2017 | Takahashi | |
| 2021/0025616 | A1* | 1/2021 | Kim | F24F 11/0008 |

FOREIGN PATENT DOCUMENTS

| | | | |
|---|---|---|---|
| KR | 20090028856 | | 3/2009 |
| KR | 10-1630143 | B1 | 6/2016 |
| KR | 20200012224 | | 2/2020 |

* cited by examiner

[Fig. 1]
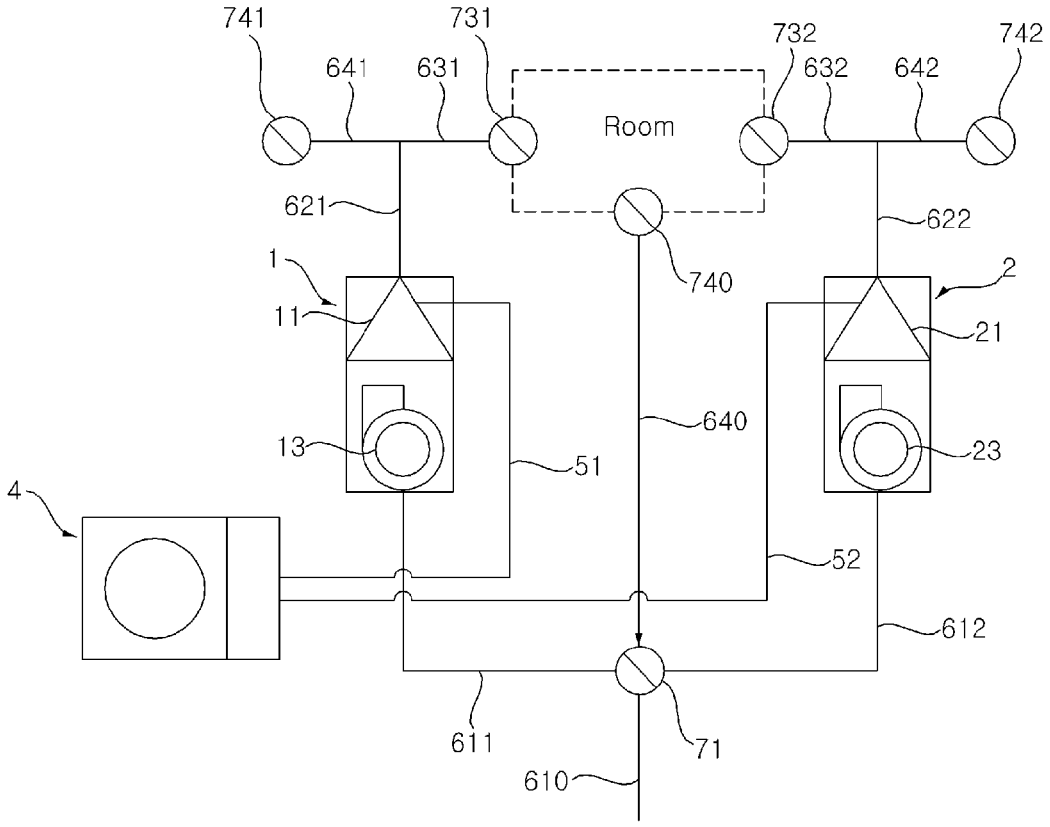

[Fig. 2]
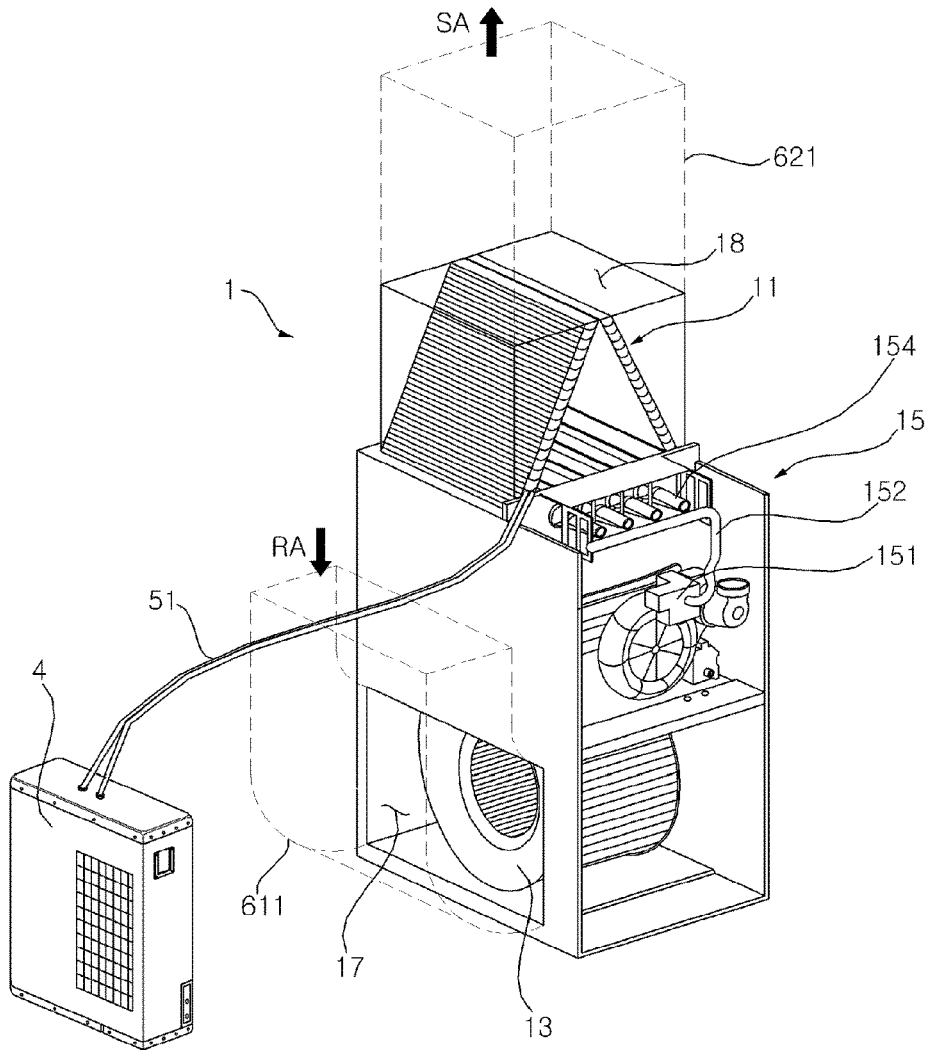
[Fig. 3]
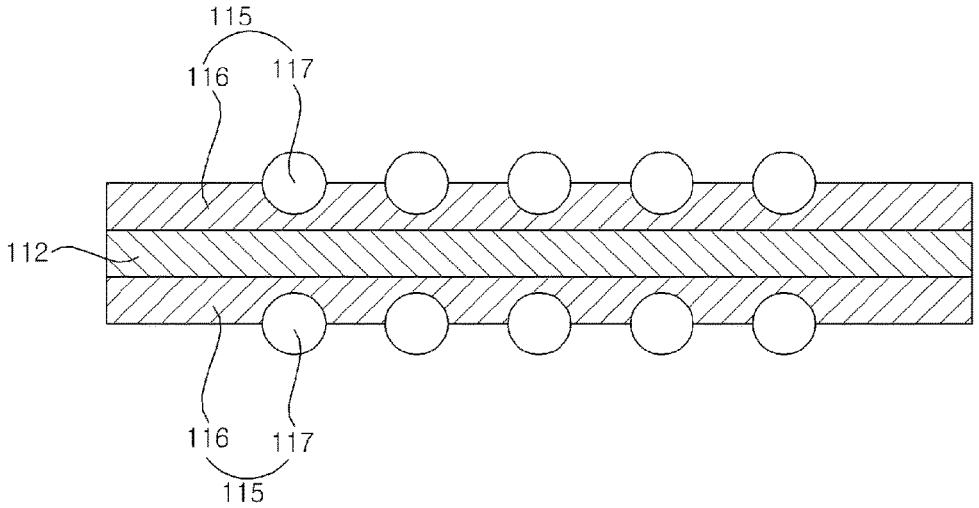

[Fig. 4]
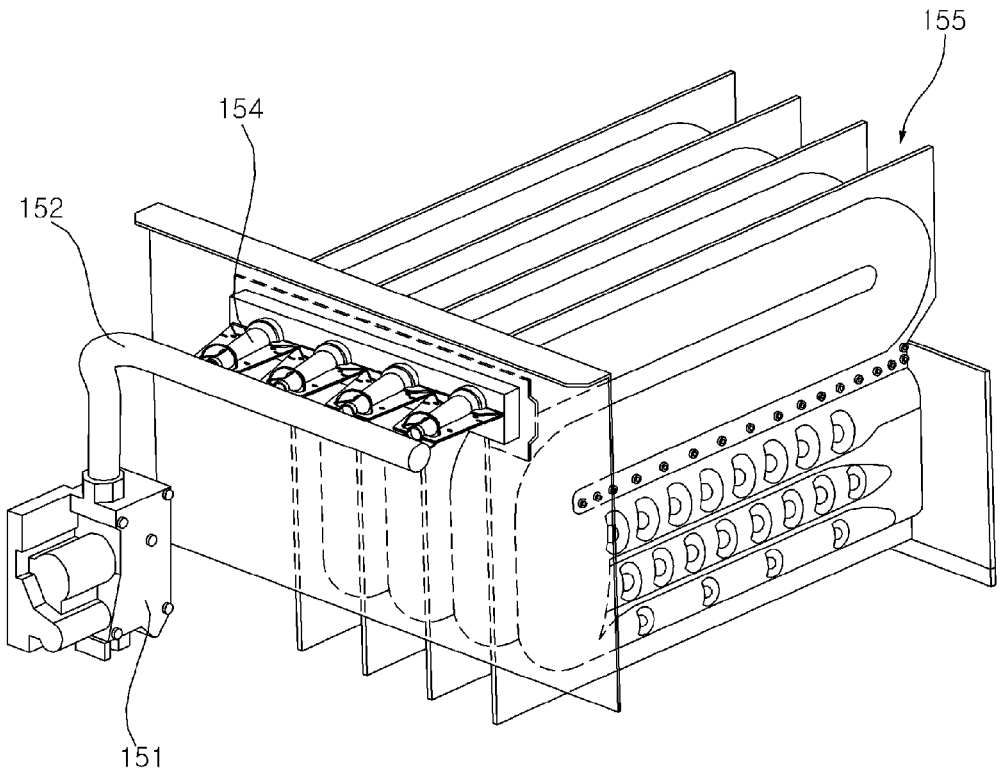
[Fig. 5]
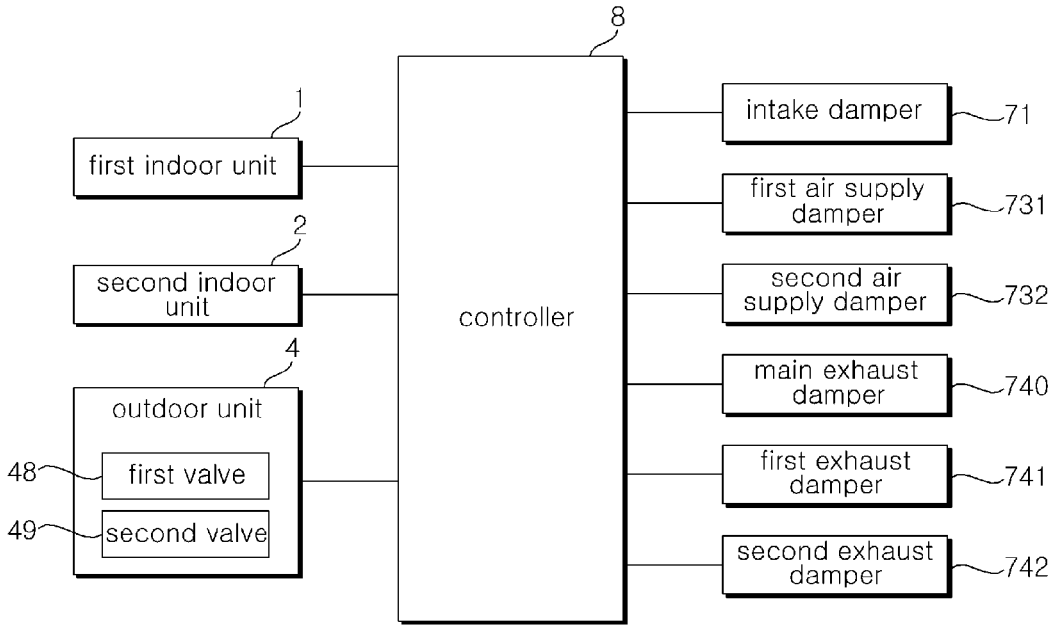

[Fig. 6]
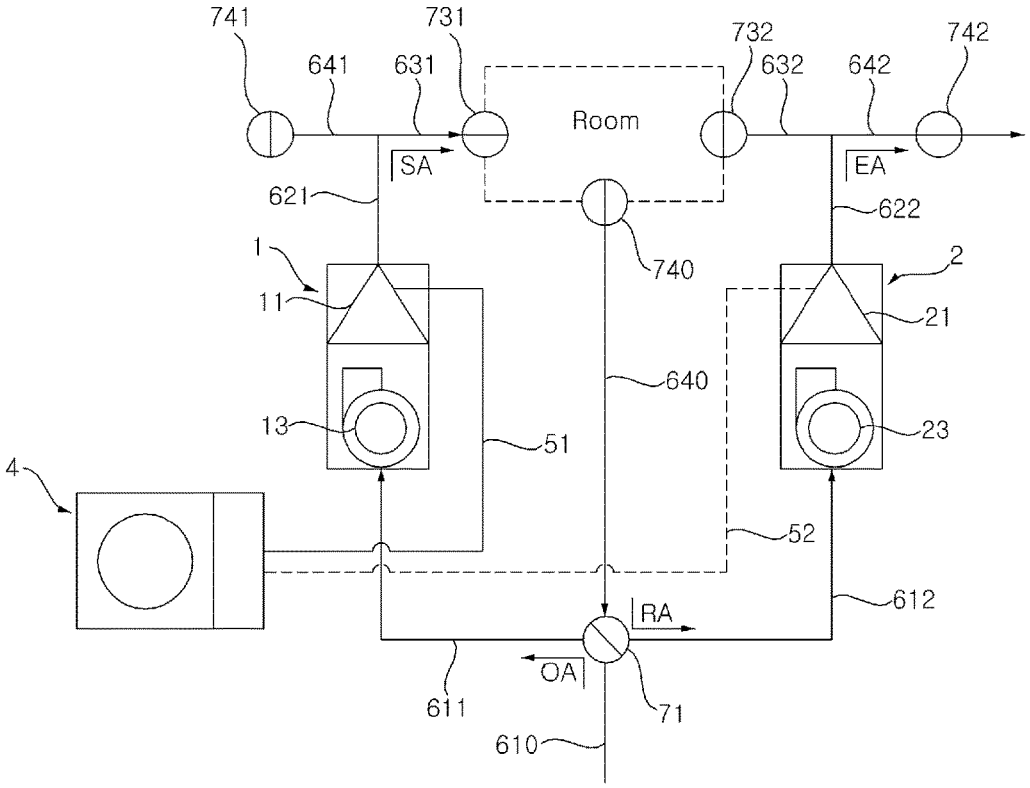
[Fig. 7]
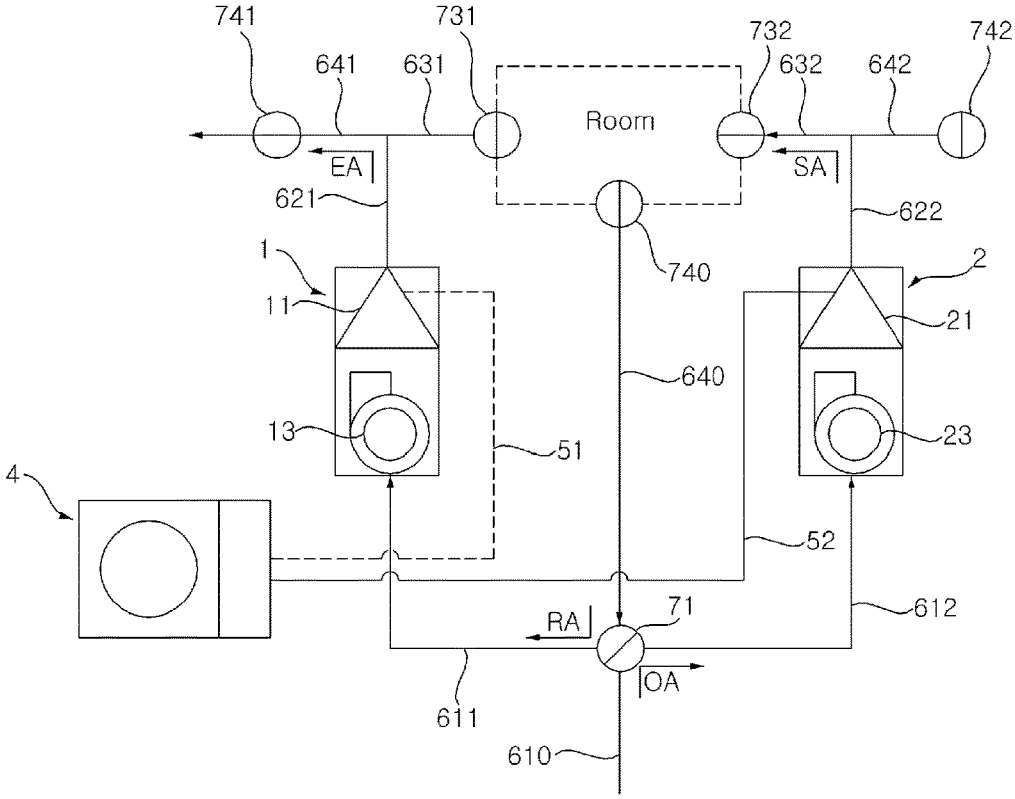

[Fig. 8]
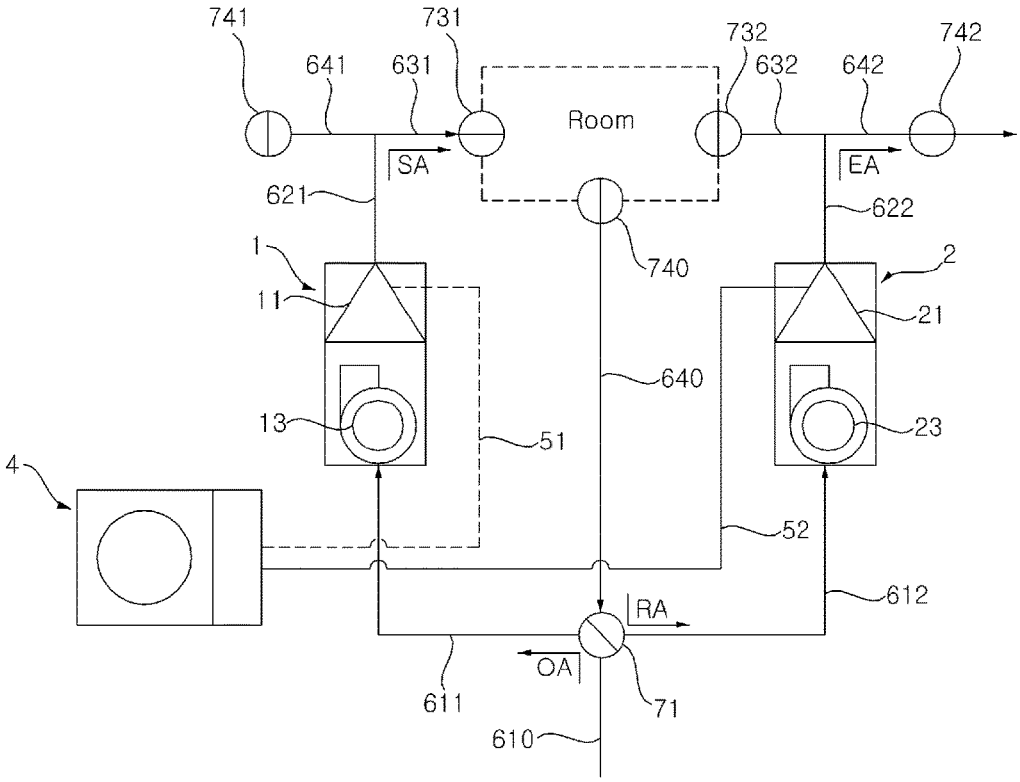
[Fig. 9]
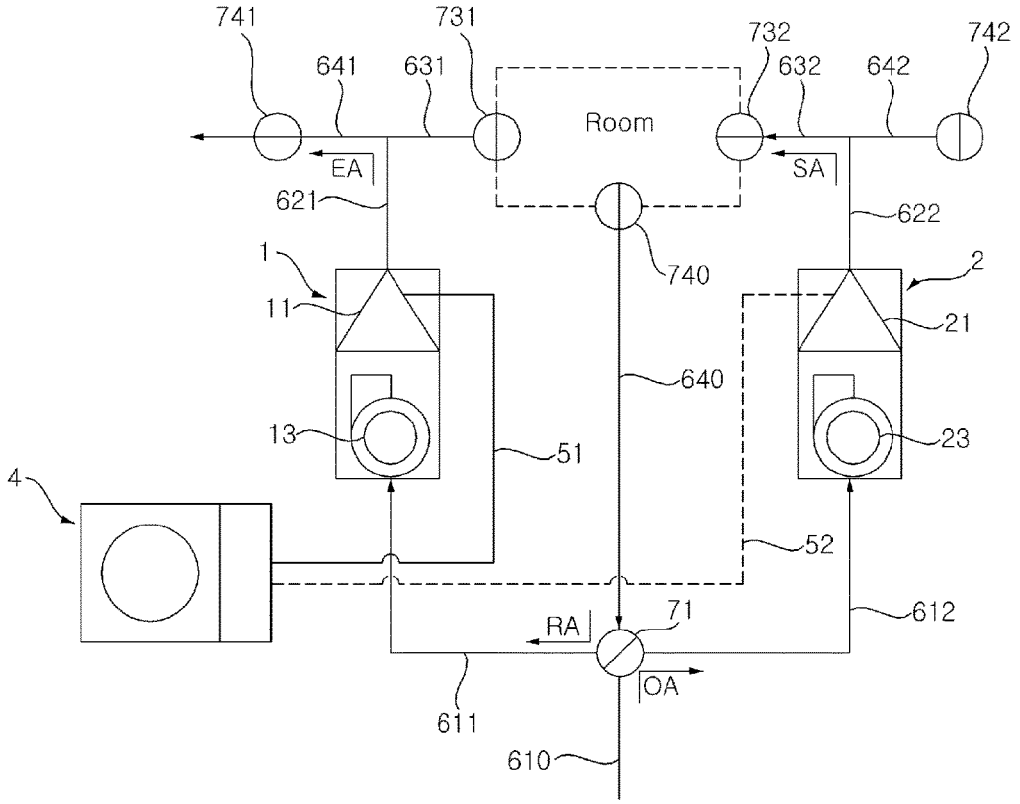

[Fig. 10]
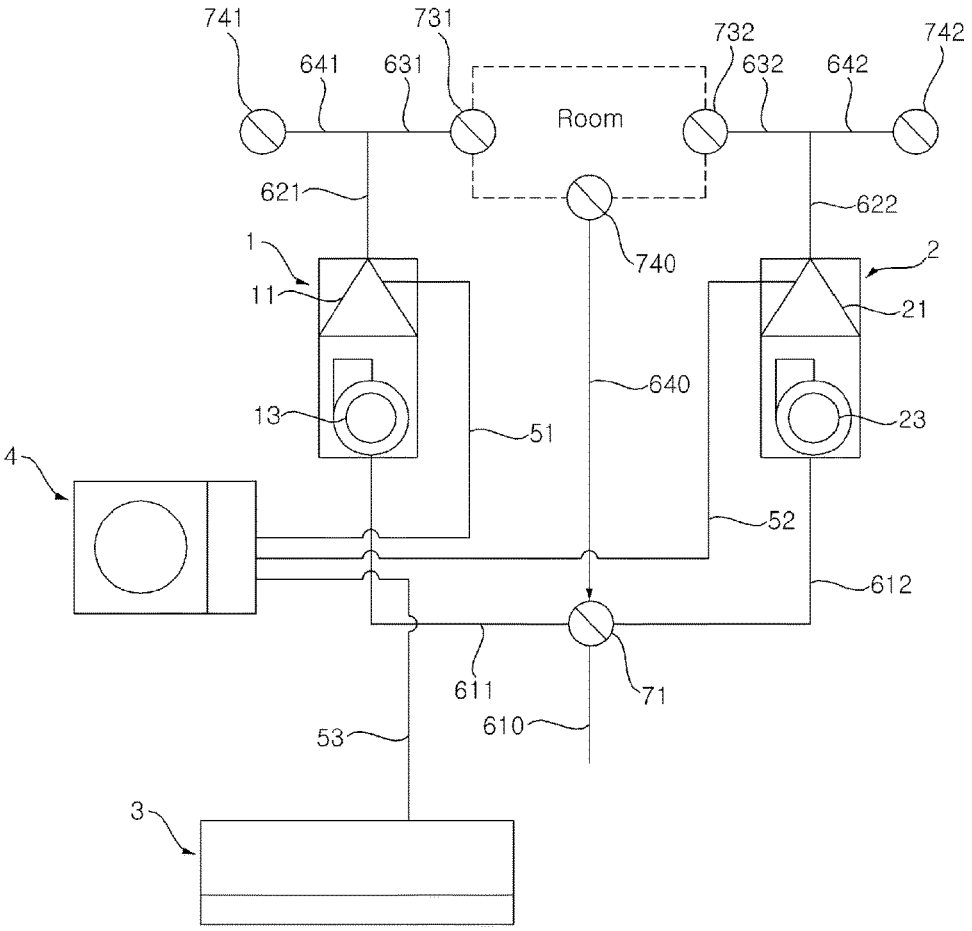
[Fig. 11]
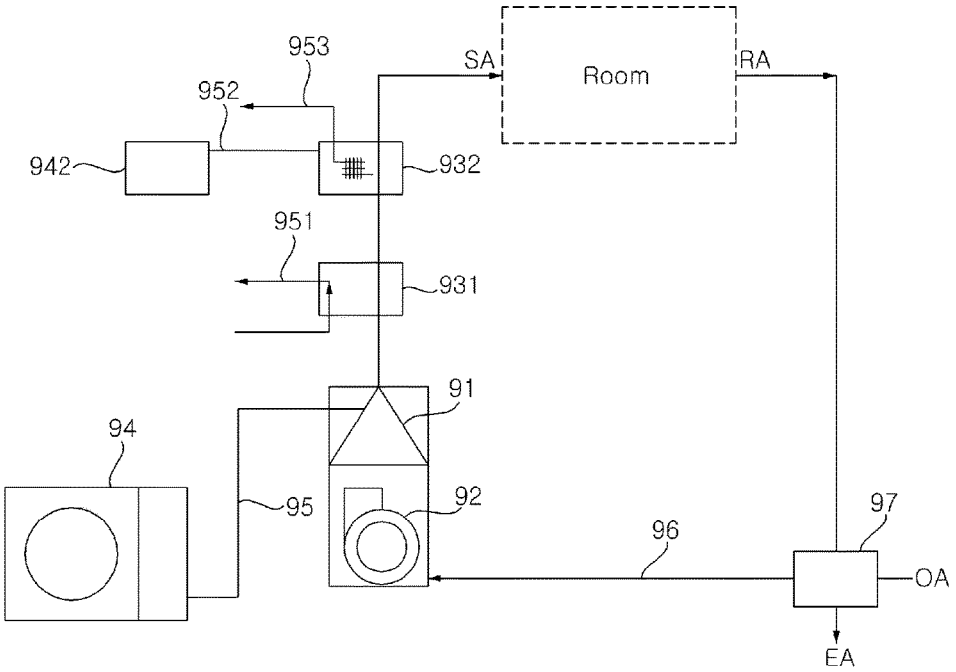

[Fig. 12]
97
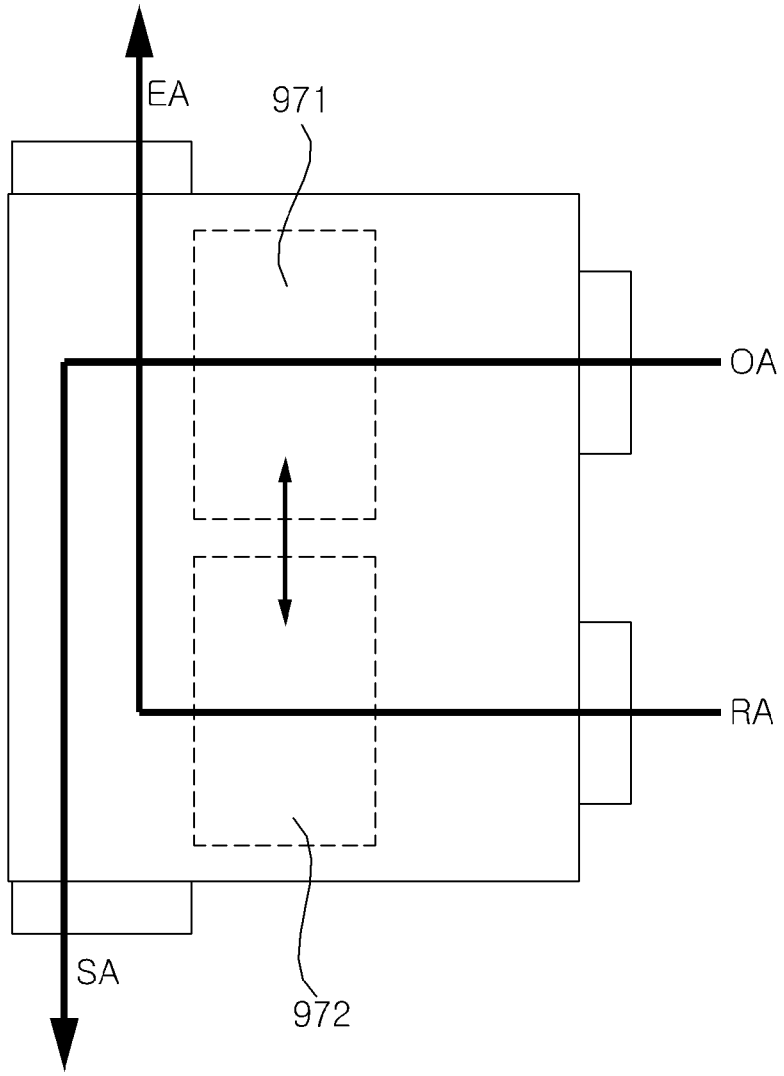

AIR CONDITIONER

CROSS-REFERENCE TO RELATED APPLICATIONS

This application is a National Stage application under 35 U.S.C. § 371 of International Application No. PCT/KR2020/018044, filed on Dec. 10, 2020, which claims the benefit of Korean Application No. 10-2020-0027361, filed on Mar. 4, 2020. The disclosures of the prior applications are incorporated by reference in their entirety.

TECHNICAL FIELD

The present disclosure relates to an air conditioner, and more particularly to an air conditioner able to control a temperature and humidity with the use of a moisture absorbent disposed at a heat exchanger exchanging heat between refrigerant and air.

BACKGROUND ART

An air conditioner is a device exchanging heat between air and refrigerant flowing through a heat exchanger so as to supply air-conditioned air to indoor. A unitary type air conditioner of air conditioners connects an indoor unit and indoor space through a duct, and supply air-conditioned air in the heat exchanger and/or a gas furnace to an indoor space.

FIG. 11 is a schematic view showing a conventional unitary type air conditioner. The indoor unit of the air conditioner includes an indoor heat exchanger 91 which is so-called a-coil and heater 92. The indoor heat exchanger 91 is connected to an outdoor 94 through a refrigerant passage 95, and the heater 92 includes a fan and a gas furnace.

The heat exchanger of the outdoor unit during cooling operation functions as a condenser, and the heat exchanger 91 functions as an evaporator so as to absorb heat from outdoor air sucked from a duct 96 and supply cooled air to indoor space through the duct 96. The gas furnace is not in an operation during cooling operation.

Refrigeration cycle is not in an operation during heating operation, outdoor air is heated by the gas furnace, and then heated air is supplied to indoor space. Alternatively, it is possible that the indoor heat exchanger 91 functions as a condenser so as to supply heated air to indoor space in conjunction with the heater 92.

There may be also further provided with a humidifier 931 and a dehumidifier 932 for controlling humidity in an indoor space. During cooling operation, the refrigeration cycle can supply low temperature and dry air to an indoor space in conjunction with the dehumidifier 932. During heating operation, the heater 92 can supply high temperature and humid air to an indoor space in conjunction with the humidifier 931.

The dehumidifier 932 is connected to a dehumidifying outdoor unit 942 through a refrigerant passage 952. Thus, in order to supply dry air to an outdoor space with the use of the dehumidifier 932, dehumidifying outdoor unit 942 is required separately from the outdoor unit 94. Further, there is a need to employ a water drain passage 953 for discharging condensate water.

The humidifier 931 is required to employ a water supply passage 951 supplying water to the humidifier 931 for generating moisture.

Air air-conditioned in the indoor units 91, 92 flows into the indoor space, and then air discharged from the indoor space again may flow into the indoor units 91, 92. In doing so, air in the indoor space deteriorates. To solve this problem, there may be provided with a ventilation device 97.

The ventilation device 97 is able to exhaust air RA discharged from the indoor space to outdoor, and then to supply air in outdoor to the indoor units 91, 92.

Meanwhile, recently as shown in FIG. 12, there is a development for a device capable of dehumidifying, humidifying and ventilating with the use of an evaporator 971 wherein absorbent is coated on the ventilation device 97 and the condenser 972. The absorbent is used as a material for absorbing moisture under low temperature, and discharging moisture from moisture that had absorbed under high temperature.

In case of applying the ventilation device 97 as shown in FIG. 12 to a unitary type air conditioner, there is an advantage of not requiring the water supply passage 951 and the water drain passage 953. However, the ventilation device 97 is large in volume, so it is required for much more spare room, thus large-scale construction is required for the ventilation device 97 to be connected to existing ducts.

In addition, when the evaporator 971 and the condenser 972 are mounted in one ventilation device 97, an interference caused by heat transfer therebetween is occurred, so performance of dehumidifying and humidifying deteriorates.

Further, conventional unitary type air conditioner has a disadvantage of not being able to make use of a gas furnace in summer when is required for cooling.

DISCLOSURE OF INVENTION

Technical Problem

One object of the present disclosure is to provide an air conditioner capable of humidifying and dehumidifying without employing separately a water supply passage and a water drain passage.

Another object of the present disclosure is to provide an air conditioner capable of humidifying, dehumidifying and ventilating without employing separately ventilation device as well as a water supply passage and a water drain passage.

Objects of the present disclosure should not be limited to the aforementioned objects and other unmentioned objects will be clearly understood by those skilled in the art from the following description.

Solution to Problem

In accordance with an embodiment of the present disclosure, the above and other objects can be accomplished by the provision of air conditioner including an outdoor unit, a first indoor unit having a first indoor heat exchanger connected to the outdoor unit, a first intake duct connected to an inlet opening of the first indoor unit, a first air supply duct guiding air discharged from an outlet opening of the first indoor unit to an indoor room, a second indoor unit having a second indoor heat exchanger connected to the outdoor unit, a second intake duct connected to an inlet opening of the second indoor unit and a second air supply duct guiding air discharged from an outlet of the second indoor unit to the indoor room, wherein the first indoor heat exchanger and the second indoor heat exchanger include a moisture absorption layers.

Each of the moisture absorption layer of the first and second indoor heat exchangers may discharge moisture under high temperature, and absorb moisture under low temperature.

The air conditioner may further comprise a controller being configured to control operation of the first and second indoor units and the outdoor unit.

The controller may be configured to alternately perform a first cooling cycle supplying low temperature and dry air to the indoor room through the first indoor unit and a second cooling cycle supplying low temperature and dry air to the indoor room through the second indoor unit.

The first indoor unit in the second cooling cycle may heat air discharged from the indoor room and discharge the heated air to the outdoor, and the second indoor unit in the first cooling cycle may heat air discharged from the indoor room and discharge the heated air to the outdoor.

The controller may be configured to alternately perform a first cooling cycle in which the first indoor heat exchanger functions as an evaporator and a second cooling cycle in which the second indoor heat exchanger functions as an evaporator.

The air conditioner may further comprise a first refrigerant passage connecting the outdoor unit and the first indoor heat exchanger, a second refrigerant passage connecting the outdoor unit and the second indoor heat exchanger, a first valve regulating flow refrigerant passing through the first refrigerant passage and a second valve regulating flow of refrigerant passing through the second refrigerant passage, wherein the controller may be configured to open the first valve and close the second valve in the first cooling cycle, and close the first valve and open the second valve in the second cooling cycle.

The first indoor unit may further include a first gas furnace heating air flowed into the first indoor unit, and wherein the second indoor unit may further include a second gas furnace heating air flowed into the second indoor unit, wherein the controller stops operation of the first gas furnace and operates the second gas furnace in the first cooling cycle, and wherein the controller may operate the first gas furnace and stops operation of the second gas furnace in the second cooling cycle.

The controller may be configured to perform the first cooling cycle for a first predetermined time and the second cooling cycle for a second predetermined time, wherein the controller may be configured to alternately perform the first cooling cycle and the second cooling cycle.

The controller may configured to alternately perform a first heating cycle supplying high temperature and humid air to the indoor room through the first indoor unit and a second heating cycle supplying high temperature and humid air to the indoor room through the second indoor unit.

The first indoor unit may cool air discharged from the indoor room and then, discharge the cooled air to the outdoor in the second heating cycle, and the second indoor unit may cool air discharged from the indoor room and then, discharge the cooled air to the outdoor in the first heating cycle.

The first indoor unit may further include a first gas furnace heating air flowed into the first indoor unit, wherein the second indoor unit further may include a second gas furnace heating air flowed into the second indoor unit, and wherein the controller may be configured to operate the first gas furnace in the first heating cycle and the second gas furnace in the second heating cycle.

An air conditioner may further comprise a first refrigerant passage connecting the outdoor unit and the first indoor heat exchanger, a second refrigerant passage connecting the outdoor unit and the second indoor heat exchanger, a first valve regulating flow of refrigerant passing through the first refrigerant passage and a second valve regulating flow of refrigerant passing through the second refrigerant passage, wherein the controller is configured to close the first valve and open the second valve in the first heating cycle, and open the first valve and close the second valve in the second heating cycle.

The first indoor heat exchanger may function as an evaporator in the second heating cycle, and wherein the second indoor heat exchanger may function as an evaporator in the first heating cycle, wherein the controller may be configured to stop operation of the second gas furnace in the first heating cycle, and stop operation of the first gas furnace in the second heating cycle.

The air conditioner may further comprise a main intake duct connected to the first intake duct and the second intake duct, a main exhaust duct connecting the indoor room, the first and second intake ducts and the main intake duct and an intake damper disposed at a position that the first and second intake ducts, the main intake duct and the main exhaust duct are connected, wherein the intake duct selectively connects the main intake duct to one of the first intake duct and the second intake duct, and wherein the intake duct selectively connects the main intake duct to the other duct of the first intake duct and the second intake duct.

The air conditioner may further comprise a controller being configured to control the intake damper, wherein the controller may be configured to perform alternately the first cycle supplying air to the indoor room through the first indoor unit and the second cycle supplying air to the indoor room through the second indoor unit.

The controller may be configured to control the intake damper to connect the main intake duct and the first intake duct, and to connect the main exhaust duct and the second intake duct in the first cycle, and wherein the controller may be configured to control the intake damper to connect the main intake duct and the second intake duct, and to connect the main exhaust duct and the first intake duct in the second cycle.

The air conditioner may further comprise a first air supply damper disposed at the first air supply duct for opening or closing the first air supply duct, a second air supply damper disposed at the second air supply duct for opening or closing the second air supply duct and a controller configured to regulate opening or closing of the first and second air supply dampers, wherein the controller may be configured to alternately perform a first cycle opening the first air supply damper and closing the second air supply damper and a second cycle closing the first air supply damper and opening the second air supply damper.

The air conditioner may further comprise a first discharge duct connecting an outlet opening of the first indoor unit and the first air supply duct, a first exhaust duct connecting the first discharge duct and outdoor, a second discharge duct connecting an outlet opening of the second indoor unit and the second air supply duct, a second exhaust duct connecting the second discharge duct and the outdoor, a first exhaust damper disposed at the first exhaust duct for opening or closing the first exhaust duct and a second exhaust damper disposed at the second exhaust duct for opening or closing the second exhaust duct, wherein the controller may be configured to close the first exhaust damper and open the second exhaust damper in the first cycle, and to open the first exhaust damper and close the second exhaust damper in the second cycle.

The first indoor unit further may comprise a first gas furnace disposed between the first indoor heat exchanger and the inlet opening for heating air flowed into the first indoor unit, and wherein the second indoor unit may further comprise a second gas furnace disposed between the second indoor heat exchanger and the inlet opening for heating air flowed into the second indoor unit.

Advantageous Effects of Invention

The air conditioner including the same according to the present disclosure provides at least the following effects.

First, the indoor heat exchanger has the moisture absorption layer, so it is possible to humidify and dehumidify without a water supply passage for humidifying and a water drain passage for draining water condensed by dehumidifying.

Second, it is possible to cool and dehumidify with the use of one indoor unit, and simultaneously to discharge moisture absorbed in the other indoor unit with exhaust gas, so it is possible to cool, dehumidify and ventilate without employing separately ventilation device.

Third, it is possible to heat with the use of one indoor unit and supply moisture absorbed in the indoor unit with air to the indoor space, and simultaneously discharge air to the other indoor unit with the use of the other indoor unit, so it is possible to heat, humidify and ventilate without employing separately ventiliation device.

It should be understood that advantageous effects according to the present invention are not limited to the effects set forth above and other advantageous effects of the present disclosure will be apparent from the detailed description of the present disclosure.

BRIEF DESCRIPTION OF DRAWINGS

FIG. 1 is a schematic view showing an air conditioner according to an exemplary embodiment of the present disclosure.

FIG. 2 is a perspective view showing an indoor unit and an outdoor unit of the air conditioner according to an exemplary embodiment of the present disclosure.

FIG. 3 is a schematic view showing moisture absorption layer of the indoor heat exchanger of FIG. 1.

FIG. 4 is a perspective view showing a gas furnace of FIG. 2.

FIG. 5 is a block diagram controlling the air conditioner according to an exemplary embodiment of the present disclosure.

FIG. 6 is a schematic view showing refrigerant-flow and air-flow in a first cooling cycle of the air conditioner according to an exemplary embodiment of the present disclosure.

FIG. 7 is a schematic view showing refrigerant-flow and air-flow in a second cooling cycle of the air conditioner according to an exemplary embodiment of the present disclosure.

FIG. 8 is a schematic view showing refrigerant-flow and air-flow in a first heating cycle of the air conditioner according to an exemplary embodiment of the present disclosure.

FIG. 9 is a schematic view showing refrigerant-flow and air-flow in a second heating cycle of the air conditioner according to an exemplary embodiment of the present disclosure.

FIG. 10 is a schematic view showing the air conditioner further including a third indoor unit disposed at the indoor space.

FIG. 11 is a schematic view showing the conventional unitary type air conditioner.

FIG. 12 is a schematic view showing the conventional ventilation device having an evaporator and a condenser.

MODE FOR THE INVENTION

Advantages and features of the present disclosure and methods of achieving the advantages and features will be apparent with reference to embodiments described below in detail in conjunction with the accompanying drawings. However, the present disclosure is not limited to embodiments disclosed below, but may be implemented in various forms, only the present embodiments are provided so that a disclosure of the present disclosure is complete and a disclosure of a scope of the invention is fully understood by those skilled in the art to which the present disclosure belongs, and the present disclosure is only defined by the scope of the claims. The same reference numerals indicate the same components through the specification.

Hereinafter, an air conditioner according to an exemplary embodiment of the present disclosure will be described with the accompanying drawings.

Referring to FIG. 1 and FIG. 2, an air conditioner according to an exemplary embodiment of the present disclosure includes an outdoor unit 4 and indoor units 1, 2 connected to the outdoor unit 4. The outdoor unit 4 and the indoor units 1, 2 are connected to refrigerant passages 51, 52 so as to form a refrigeration cycle. The indoor units 1, 2 are connected to the outdoor and indoor units through a duct 6.

Meanwhile, FIG. 2 is showing a first indoor unit 1 and the outdoor unit 4 which have the same structure each other. Referring to FIG. 1 and FIG. 2, the air conditioner including the first and second indoor units 1, 2 will be described.

The outdoor unit 4 includes a compressor (not shown) for compressing refrigerant, an outdoor heat exchanger (not shown) for exchanging heat between refrigerant and air and an expansion valve (not shown). The outdoor unit 4 may further include an outdoor fan (not shown) for causing air-flow.

The outdoor unit 4 may be an outdoor unit only for cooling. In a case that the outdoor unit 4 is only for cooling, high temperature and high pressure refrigerant compressed in the compressor flows into the outdoor heat exchanger. And, the refrigerant is condensed by exchanging heat with air in the outdoor heat exchanger, then expanded in low temperature and low pressure while passing through the expansion valve. Refrigerant expanded is guided to the indoor heat exchangers 11, 12 through the refrigerant passages 51, 52.

The outdoor heat exchanger allows refrigerant sucked to exchange heat with air. Refrigerant may be condensed by exchanging heat with air. The outdoor heat exchanger is able to function as a condenser.

The expansion valve may be disposed at the outdoor unit 4 as the foresaid. Alternatively, the expansion valve may be disposed at the indoor units 1, 2. In a case that the expansion valve is disposed at the indoor units 1, 2, refrigerant condensed in the outdoor heat exchanger is flowed into the indoor unit through the refrigerant passages 51, 52. Refrigerant flowed into the indoor unit is expanded while passing through the expansion valve, then is flowed into the indoor heat exchangers 11, 12.

The indoor units 1, 2 are connected to the outdoor unit 4. The indoor units 1, 2 are connected to the outdoor unit 4 through the refrigerant passages 51, 52. The indoor heat exchangers 11, 12 of the indoor units 1, 2 are connected to the outdoor unit 4 through the refrigerant passages 51, 52.

The indoor units 1, 2 include the indoor heat exchangers 11, 12. The indoor heat exchanger 11 exchanges heat between refrigerant discharged from the expansion valve an air. The refrigerant is evaporated while passing through the indoor heat exchanger 11, then air is cooled. The indoor heat exchanger 11 functions as an evaporator.

The indoor units 1, 2 may include inlet openings 17, 27 through which air flows into and outlet openings 18, 28 through which air discharges. The indoor units 1, 2 may include fans 13, 23. The fans 13, 23 may blow air from the inlet opening of the indoor units 1, 2 to the outlet opening. After the fans 13, 23 suck outdoor air OA, the fans 13, 23 supply air to the indoor space through the indoor heat exchangers 11, 21, then discharge the air RA discharged from the indoor space to outside.

The indoor units 1, 2 may include a first indoor unit 1 and a second indoor unit 2. The first indoor unit 1 is connected to the outdoor unit 4 through a first refrigerant passage 51, and the second indoor unit 2 is connected to the outdoor unit 4 through a second refrigerant passage 52.

The refrigerant passages 51, 52 include the first refrigerant 51 connecting the outdoor unit 4 and the first indoor unit 1 and the second refrigerant passage 52 connecting the outdoor unit 4 and the second outdoor unit 2. Herein, the first refrigerant passage 51 and the second refrigerant passage 52 are illustrated respectively as one line in the accompanying drawings. That is, the first refrigerant passage may include a liquid passage through which liquid-phase refrigerant or two-phase refrigerant having liquid and gas refrigerant flow and a gas passage through which gas-phase refrigerant flows. And, the second refrigerant passage may also include a liquid passage through which liquid-phase refrigerant or two-phase refrigerant having liquid and gas refrigerant flows.

The first refrigerant passage 51 may include the liquid passage (not shown) connecting the expansion valve of the outdoor unit 4 and the first indoor heat exchanger 11 and a gas passage connecting the first indoor heat exchanger 11 and upstream side of a compressor of the outdoor unit 4. The second refrigerant passage 52 may include a liquid passage (not shown) connecting the expansion valve of the outdoor unit 4 and the second outdoor heat exchanger 21 and a gas passage connected to the second indoor heat exchanger 21 and upstream side of a compressor of the outdoor unit 4.

A refrigerant passage disposed at downstream side of the expansion valve of the outdoor unit 4 may be branched into the liquid passage of first refrigerant passage 51 and a liquid passage of the second refrigerant passage 52. A gas passage of the first refrigerant passage 51 and a gas refrigerant of the second refrigerant passage 52 may be joined so as to be connected to upstream side of the outdoor unit 4.

The air conditioner according to an exemplary embodiment of the present disclosure may include a first valve 48 (referred to FIG. 5) determining whether to allow refrigerant to flow in the first refrigerant passage and a second valve 49 (referred to FIG. 5) determining whether to allow refrigerant to flow in the second refrigerant passage.

Meanwhile, the air conditioner according to an exemplary embodiment of the present disclosure may include two outdoor units 4 so as to be respectively connected to the first and second indoor units 2 other than employing one outdoor unit 4 connected to the first indoor unit 1 and the second indoor unit 2 as described.

The indoor unit 1, 2 may further include gas furnaces 15, 25. The first indoor unit 1 may include the first gas furnace 15. The second indoor unit 2 may include a second gas furnace 25. The gas furnaces 15, 25 will be described later referring to FIG. 4.

The indoor heat exchanger 11 may include a moisture absorption layer 115. The moisture absorption layer 115 functions to absorb moisture under low temperature, and discharge moisture absorbed under high temperature. Referring to FIG. 3, the moisture absorption layer 115 will be described below.

The indoor units 1, 2 are connected to the outdoor space and indoor space through the duct 6. Outdoor air flows into the inlet openings 17, 27 of the indoor units 1, 2 through the duct 6, and then air SA discharged to the outlet openings 18, 28 of the indoor unit may be supplied to indoor space. Air RA discharged from indoor space may flow into the indoor units 1, 2 through the duct, and then air flowed into the indoor units 1, 2 after being discharged from indoor space may be discharged to the outdoor unit through the duct 6.

The duct 6 may include an intake duct 61 connected to the inlet openings 17, 27 of the indoor units 1, 2, air supply duct 63 connected to indoor room so as to guide air discharged from the outlet openings 18, 28 of the indoor units 1, 2 to the indoor room and an exhaust duct 64 guiding air discharged from the indoor room to outdoor. Further, the duct 6 may further include a discharge duct 62 connected to the outlet openings 18, 28 of the indoor units 1, 2.

The intake duct 61 may include a main intake duct 610 connected to outdoor so as to allow outdoor air OA to flow therein and first and second intake ducts 611, 612 branched from the main intake duct 610 so as to be respectively connected to the first indoor unit and the second indoor unit. A first end of the first intake duct 611 may be connected to the main intake duct 610, and the second end of the first intake duct 611 may be connected to the inlet opening 17 of the first indoor unit 1. A first end of the second intake duct 612 may be connected to the main intake duct 610, and a second end of the second intake duct 6 may be connected to the inlet opening 27 of the second indoor unit 2.

The discharge duct 62 may include a first discharge duct 621 connected to the outlet opening 18 of the first indoor unit 1 and a second discharge duct 622 connected to the outlet opening 28 of the second indoor unit 2. The first end of the first discharge duct 621 may be connected to the outlet opening 18 of the first indoor unit 1, and the second end of the first discharge duct 621 may be connected to the a first air supply duct 631 as described later. The first end of the second discharge duct 622 may be connected to the outlet opening 28 of the second indoor unit 2, and the second end of the second discharge duct 622 may be connected to a second air supply duct 632 as described later.

The second end of the first discharge duct 621 may be branched into the first air supply duct 631 and a first exhaust duct 641 as described later. The second end of the second discharge duct 622 may be branched into the second air supply duct 632 and a second exhaust duct 642 as described later.

The air supply duct 63 may include the first air supply duct 631 guiding air discharged from the first indoor unit 1 to indoor room and the second air supply duct 632 guiding air discharged from the second indoor unit 2 to the indoor room. A first end of the first air supply duct 631 may be connected to the first discharge duct 621, and the second end of the first air supply duct 631 may be connected to the indoor room. The first end of the second air supply duct 632 may be connected to the second discharge duct 622, and the second end of the second air supply duct 632 may be connected to the indoor room.

The exhaust duct 64 may include a main exhaust duct 640 connected to indoor room and first and second exhaust ducts 641, 642 connected to outdoor. A first end of the main exhaust duct 640 may be connected to indoor room, and a second end of the main exhaust duct 640 may be connected to outdoor. A first end of the second exhaust duct 642 may be connected to the second discharge duct 621, and a second end of the second exhaust duct 642 may be connected to outdoor. The second end of the main exhaust duct 640 may be connected to the intake duct 61 at a position connected to the main intake duct 610, the first intake duct 611 and the second intake duct 612.

The air conditioner according to an exemplary embodiment of the present disclosure may include a damper 7 for adjusting air-flow in the duct 6. The duct 6 may include an intake damper 71 adjusting air-flow in the intake duct 61 and an exhaust damper 74 adjusting air-flow exhausting from the indoor room or duct to outdoor.

The intake damper 71 is able to adjust flow rate of outdoor air flowed from the main intake duct 610. The intake damper 71 is able to adjust flow rate of air discharged from indoor room to the main exhaust duct 640.

The intake damper 71 is able to guide outdoor air flowed into the main intake duct 610 to one of the first intake duct 611 or the second intake duct 612, and selectively guide air RA flowing through the main exhaust duct 640 to the other of the first intake duct 611 or the second intake duct 612. For example, the intake damper 71 is able to disconnect the second intake duct 612 while connecting the main intake duct 610 to the first intake duct 611. And at the same time, the intake damper 71 is able to disconnect the first intake duct 611 while connecting the main exhaust duct 610 to the second intake duct 612.

The intake damper 71 may be installed at a position which the main intake duct 610, the first intake duct 611, the second intake duct 612 and the main exhaust duct 640 are connected. The intake damper 71 may include a plate (not shown), the plate is able to rotate with respect to a rotating axis parallel to the plate. In doing so, the main intake duct 610 may be connected to one of the first intake duct 611 and the second intake duct 612, and the main exhaust duct 640 may be connected to the other.

The air supply damper 73 may include a first air supply damper 731 opening or closing the first air supply duct 631 and a second air supply damper 732 opening or closing the second air supply duct 632. When the first air supply damper 731 is opened, air SA discharged from the first indoor unit 1 may be supplied to indoor room. When the second air supply damper 732 is opened, air SA discharged from the second indoor unit 2 may be supplied to indoor room.

The first air supply damper 731 may be disposed at an indoor room of the first air supply duct 631, and the second air supply damper 732 may be disposed at an indoor room of the second air supply duct 632. The first and second air supply ducts 731, 732 may be exposed to indoor room.

The exhaust damper 74 may include a main exhaust damper 740 opening or closing the main exhaust duct 640, a first exhaust damper 741 opening the first exhaust duct 641 and a second exhaust damper 742 opening or closing the second exhaust duct 642. When the main exhaust damper 740 is opened, air RA in an indoor room may be flowed into the main exhaust damper 740. When the first exhaust damper 741 is opened, air EA discharged from the first indoor unit 1 may be discharged to outdoor. When the second exhaust damper 742 is opened, air EA discharged from the second indoor unit 2 may be discharged to outdoor.

The main exhaust damper 740 may be disposed at an indoor room of the main exhaust duct 640. The first exhaust damper 741 may be disposed at an outside of the first exhaust duct 642. The main exhaust damper 740 may be exposed to an indoor room, and the first and second exhaust dampers 741, 742 may be exposed to outdoor.

Meanwhile, the outdoor unit 4 may be an outdoor unit for both cooling and heating. In this case, the outdoor unit 4 may further include a four-way valve (not shown) guiding refrigerant compressed in the compressor selectively to outdoor heat exchanger or the indoor heat exchangers 11, 21.

The four-way valve may be connected to a refrigerant passage disposed at upstream side of the compressor of the outdoor unit 4, a refrigerant passage disposed at downstream side of the compressor, a gas passage connected to the indoor heat exchangers 11, 12 and a gas passage connected to the outdoor heat exchanger.

During cooling operation, the four-way valve is able to guide refrigerant compressed by the compressor to the outdoor heat exchanger, and refrigerant discharged from the indoor heat exchangers 11, 21 to the compressor. During cooling operation, the outdoor heat exchanger is able to condense high temperature and high pressure refrigerant compressed in the compressor by exchanging heat with air. During cooling operation, the indoor heat exchangers 11, 21 is able to evaporate low temperature and low pressure refrigerant expanded in the expansion valve by exchanging heat with air. During cooling operation, the outdoor heat exchanger functions as a condenser, and the indoor heat exchangers 11, 21 functions as an evaporator.

During heating operation, the four-way valve is able to guide refrigerant compressed by the compressor to the indoor heat exchangers 11, 21, and guide refrigerant discharged from the outdoor heat exchanger to the compressor. During heating operation, the indoor heat exchanger is able to evaporate low temperature and low pressure refrigerant expanded by the expansion valve by exchanging heat with air. During heating operation, the indoor heat exchangers 11, 21 are able to condense high temperature and high pressure refrigerant compressed by the compressor by exchanging heat with air. During heating operation, the indoor heat exchangers 11, 21 function as condenser, and the outdoor heat exchanger functions as an evaporator.

During heating operation, the gas furnaces 13, 23 is able to heat air flowed and additionally the indoor heat exchangers 11, 21 heat air while condensing refrigerant.

Referring to FIG. 3, the indoor heat exchangers 11, 12 may include moisture absorption layers 115, 215. The moisture absorption layers 115, 215 are able to absorb moisture under low temperature, and discharge moisture absorbed under high temperature. Hereinafter, a process of the moisture absorption layers 115, 215 discharging moisture will be also called regeneration.

The indoor heat exchangers 11, 12 may include tube (not shown) through which refrigerant flows and pins 112, 212 extended from the tube. The both surfaces of the pins 112, 212 may include the moisture absorption layers 115, 215.

The moisture absorption layers 115, 215 may include absorbents 117, 217 absorbing and/or discharging moisture and binders 116, 216 securing the absorbents. There may be provided with a heat exchanger including the pins 112, 212 coated by coating solution having the absorbents 117, 217 and the binders 116, 216, wherein the coating solution is coated on the pins 112, 212.

When the indoor heat exchangers 11, 21 functions as an evaporator, low temperature refrigerant flows through the indoor heat exchangers 11, 21, and the refrigerant is evaporated by absorbing heat from air. The absorbents 117, 217 are cooled while discharging heat to refrigerant. The absorbents 117, 217 are cooled, so they absorb moisture from air.

When the gas furnaces 15, 25 are in an operation or the indoor heat exchangers 11, 21 functions as a condenser, the absorbents 117, 217 absorb heat from air heated by the gas furnaces 15, 25 or high temperature refrigerant, so they are heated. The absorbents 117, 217 are heated, and then are able to discharge moisture to air.

The absorbents 117, 217 may be a material which is solid and porous. The absorbents 117, 217 may include at least one of zeolite, metallic silica ge, molecular sieve, mesoporous silisca composite and metal-organic-frame which is also known as MOF.

FIG. 4 is showing a gas furnace 15, and herein the second gas furnace 25 has the same structure as the first gas furnace 15. Referring to FIG. 4, the first and second gas furnaces 15, 25 will be described below.

Referring to FIG. 4, the indoor units 1, 2 may further include the gas furnaces 15, 25. The gas furnaces 15, 25 are a device heating indoor room by supplying flame generated by combustion of fuel gas and air heat-exchanged with high temperature fuel gas to indoor room. The first indoor unit 1 may include the first gas furnace 15. The second indoor unit 2 may include the second gas furnace 25.

As shown in FIG. 4, the gas furnaces 15, 25 include gas valves 151, 251 supplying fuel gas to a manifold 152, burners 154, 254 through which mixture containing fuel gas discharged from the manifolds 152, 252 and air flows and heating heat exchangers 155, 255 through which fuel gas generated by combustion of mixture in the burners 154, 254 flows.

Fuel gas supplied through the gas valves 151, 251 may be liquefied natural gas (LNG) made from being liquefied from natural gas or liquefied petroleum gas (LPG) generated by pressurizing gas obtained from byproduct during oil refining process.

According to opening or closing of the gas valves 151, 251, fuel gas being supplied to the manifolds 152, 252 is determined, and an amount of fuel gas being supplied to the manifolds 152, 252 is determined according to opening degree of the gas valves 151, 251. A controller 8 as described later is able to determine whether to open or close the gas valves 151, 251 or the controller 8 is able to adjust opening degree of the gas valves 151, 251.

The manifolds 152, 252 are able to guide fuel gas to the burners 154, 254. fuel gas flowed into the burners 154, 254 may be flowed in a state of forming mixture with air.

The mixture flowing through the burners 154, 254 may be combusted by spark ignition of an igniter. In this case, flame and high temperature fuel gas may be generated by combustion of the mixture.

The heating heat exchangers 155, 255 of the gas furnaces 15, 25 may include a flow passage through which combustion gas flows.

Hereinafter, referring to FIG. 5 to FIG. 9, controlling the air conditioner, air-flow and refrigerant-flow according to an exemplary embodiment of the present disclosure will be described.

FIG. 5 is a block diagram showing a control of the air conditioner according to an exemplary embodiment of the present disclosure.

Referring to FIG. 5, the air conditioner according to an exemplary embodiment of the present disclosure includes the controller 8 controlling overall operation of the air conditioner. The controller 8 is able to control the first and second indoor units 1, 2, the outdoor unit 4 and the damper 7.

FIG. 6 and FIG. 8 are a schematic view showing refrigerant-flow and air-flow of a first cycle of the air conditioner according to an exemplary embodiment of the present disclosure, and FIG. 7 and FIG. 9 are a schematic view showing refrigerant-flow and air-flow of a second cycle of the air conditioner according to an exemplary embodiment of the present disclosure.

Referring to FIG. 6 to FIG. 9, the air conditioner according to an exemplary embodiment of the present disclosure may supply air to indoor room through the first indoor unit 1. The air conditioner according to an exemplary embodiment of the present disclosure may perform the first cycle discharging air to outdoor through the second indoor unit 2 and the second cycle discharging air to outdoor through the first indoor unit 1 after supplying air to indoor room through the second indoor unit 2.

The controller 8 controls the indoor unit, the outdoor unit, the damper, and so on. The controller 8 may control the air conditioner to perform the first cycle for a first predetermined time and perform the second cycle for a second predetermined time. The first predetermined time and the second predetermined time may be the same time. The controller 8 may control the air conditioner to perform the first cycle and the second cycle alternately.

Referring to FIG. 6 and FIG. 8, the controller 8 in the first cycle controls the intake damper 71 so as to connect the main intake duct 610 and the first intake duct 611, and then connect the main exhaust duct 640 and the second intake duct 612. Further, according to control of the controller 8, the first air supply damper 731 is opened, the first exhaust damper 741 is closed, the main exhaust damper 740 is opened, the second air supply damper 732 is closed and the second exhaust damper 742 is opened.

The controller 8 controls the damper 7 in the first cycle as the foregoing, and operates the first fan 13 and the second fan 23. Hereinafter, referring to FIG. 6 and FIG. 8 air-flow in the first cycle will be described below.

Outdoor air is flowed into the main intake duct 610 by operation of the first fan 13, and then is guided to the first intake duct 611 by the intake damper 71. Air in the first intake duct 611 is flowed into the inlet opening 17 of the first indoor unit 1 by operation of the first fan 13. Air flowed into the first indoor unit 1 is discharged to the first discharge duct 621 via the first indoor heat exchanger 11 by operation of the fan 13. The first exhaust damper 741 is closed, and the first air supply damper 731 is opened, so air SA in the first discharge duct 621 is supplied to indoor room through the first air supply duct 631.

Air RA in indoor room is flowed into the main exhaust duct 640 by operation of the second fan 23, and then is guided to the second intake duct 612 by the intake damper 71. Air in the second intake duct 612 is flowed into the inlet opening 27 of the second indoor unit 2 by operation of the second fan 23. Air flowed into the second indoor unit 2 is discharged to the second discharge duct 622 via the second indoor heat exchanger 21 by operation of the second fan 23. The second air supply damper 732 is closed, and the second exhaust damper 742 is opened, so air EA in the second discharge duct 622 is discharged to outdoor through the second exhaust duct 642.

Referring to FIG. 7 and FIG. 9, the controller 8 in the second cycle controls the intake damper 71 so that the main intake duct 610 is connected to the second intake duct 612.

The main exhaust damper 740 is opened, the second air supply damper 732 is opened and the second exhaust damper 742 is closed.

The controller 8 controls the damper 7 in the second cycle as the foresaid, and operates the first fan 13 and the second fan 23. Hereinafter, referring to FIG. 7 and FIG. 9, air-flow in the second cycle will be described below.

Outdoor air OA is flowed into the main intake duct 610 by operation of the second fan 23, and then is guided to the second intake duct 612 by the intake damper 71. Air in the second intake duct 611 is flowed into the inlet opening 27 of the second indoor unit 2 by operation of the second fan 23. Air flowed into the second indoor unit 2 is discharged to the second discharge duct 622 via the second heat exchanger 21 by operation of the second fan 23. The exhaust damper 742 is closed, and the second intake damper 732 is opened, so air SA in the second discharge duct 622 is supplied to indoor room through the second intake duct 632.

Air RA in indoor room is flowed into the main exhaust duct 640 by operation of the first fan 13, and then is guided to the first intake duct 611 by the intake damper 71. Air in the first intake duct 611 is flowed into the inlet opening 17 of the first indoor unit 1 by operation of the first fan 23. Air flowed into the first indoor unit 1 is discharged to the first discharge duct 621 via the first indoor heat exchanger 11 by operation of the first fan 13. The first air supply damper 731 is closed, and the first exhaust damper 741 is opened, so air EA in the first discharge duct 621 is discharged to outdoor through the first exhaust duct 641.

Hereinafter, referring to FIG. 6 and FIG. 7, a cycle during cooling operation will be described below.

During the first cycle in case of cooling operation, the first indoor heat exchanger 11 functions to absorb moisture, and low temperature and dry air is supplied to indoor room through the second indoor heat exchanger 12. And, while the second indoor heat exchanger 12 is regenerated, high temperature and humid air is discharged to outdoor through the first indoor unit 1. Hereinafter, the second cycle during cooling operation is also called a second cooling cycle.

The controller 8 in case of cooling operation controls the indoor unit, the outdoor unit, the damper, the valve and the like. The controller 8 may control the air conditioner to perform the first cooling cycle during the first predetermined time, and then perform the second cooling cycle during the second predetermined time. The first predetermined time and the second predetermined time may be the same time. The controller 8 in case of cooling operation may control the air conditioner to perform the first cooling cycle and the second cooling cycle alternately.

Referring to FIG. 6, the controller 8 in the first cooling cycle is able to open the first valve 48 and close the second valve 49. In the first cooling cycle, the first and second fans 13, 23 and the damper 7 are controlled in the same manner as the first cooling cycle.

Meanwhile, when the outdoor unit 4 is an outdoor unit for both heating and cooling, the controller 8 in the first cooling cycle controls the four-way valve to guide refrigerant discharged from the compressor to the outdoor heat exchanger, and to guide refrigerant that had passed through the expansion valve to the first heat exchanger 11 through the first refrigerant passage.

Therefore, the first indoor heat exchanger 11 functions as an evaporator in the first cooling cycle, and the absorbent 117 on the moisture absorption layer 115 of the first indoor heat exchanger 11 is cooled, so the absorbent 117 absorb moisture. High temperature and humid outdoor air OA is flowed through the first indoor heat exchanger 11 so as to dehumidifying and cooling, and low temperature and dry air may be supplied to indoor room.

The controller 8 in the first cooling cycle may control the first gas furnace 15 to stop, and control the second gas furnace 25 to operate.

Meanwhile, when the outdoor unit 4 is an outdoor unit for both cooling and heating, the controller 8 in the first cooling cycle also controls the second valve to open and controls the four-way valve to guide refrigerant discharged from the compressor to the second indoor heat exchanger 21 through the second refrigerant 52. In this case, the second indoor heat exchanger 21 may function as a condenser.

In the first cooling cycle, the moisture absorption layer 215 of the second indoor heat exchanger 21 may be heated by the second gas furnace 25 and/or the second indoor heat exchanger. In doing so, the absorbent 217 may discharge moisture absorbed in the previous cycle (e.g., the second cooling cycle) and may be regenerated. The second indoor unit 2 is able to discharge high temperature and humid air to outdoor.

Referring to FIG. 7, the controller 8 in the second cooling cycle may close the first valve 48 and open the second valve 49. In the second cooling cycle, the first and second fans 13, 23 and the damper 7 are controlled in the same manner as the second cycle.

Meanwhile, when the outdoor unit 4 is an outdoor unit for both cooling and heating, the controller 8 in the second cooling cycle controls the four-way valve to guide refrigerant discharged from the compressor to the outdoor heat exchanger, and to guide refrigerant that had passed through the expansion valve to the second indoor heat exchanger 21 via the second refrigerant passage.

Therefore, the second indoor heat exchanger 21 in the second cooling cycle may function as an evaporator, and the absorbent 217 on the moisture absorption layer 215 of the second indoor heat exchanger 21 is cooled, so the absorbent 217 absorbs moisture. High temperature and humid outdoor air may be dehumidified and cooled while passing through the second indoor heat exchanger 21, and low temperature and dry air may be supplied to indoor room.

The controller 8 in the second cooling cycle may operate the first gas furnace 15 and stop the operation of the second gas furnace 25.

Meanwhile, when the outdoor unit 4 is an outdoor unit for both cooling and heating, the controller 8 in the second cooling cycle may control the first valve to open and control the four-way valve to guide refrigerant discharged from the compressor to the first indoor heat exchanger 11 via the first refrigerant passage 51. In this case, the first indoor heat exchanger 21 may function as a condenser.

In the second cooling cycle, the absorbent 117 on the moisture absorption layer 115 of the first indoor heat exchanger 11 may be heated by the first gas furnace 15 and/or the first indoor heat exchanger. In doing so, the absorbent 117 may discharge moisture absorbed in the previous cycle (e.g., the first cooling cycle) and may be regenerated. The first indoor unit 1 may discharge high temperature and humid air to outdoor.

Hereinafter, referring to FIG. 8 and FIG. 9, cycle in case of heating operation will be described.

During the first cycle in case of heating operation, the first indoor heat exchanger 11 is regenerated and high temperature and humid air is supplied to indoor room via the first indoor 1. And, while the second indoor heat exchanger 12 absorbs moisture, low temperature and dry air is supplied to outdoor via the second indoor unit 2. Hereinafter, the first cycle in case of heating operation is also called a first heating cycle.

During the second cycle in case of heating operation, the second indoor heat exchanger 12 is regenerated and high temperature and humid air is supplied to indoor room via the second indoor unit 2. And, while the first indoor heat exchanger 11 absorbs moisture, low temperature and dry air is discharged to outdoor via the first indoor unit 1. Hereinafter, the second cycle in case of heating operation is also called a second heating cycle.

The controller 8 in case of heating operation may control the indoor unit, the outdoor unit, the damper, the valve and the like. The controller 8 may control the air conditioner to perform the first heating cycle for the first predetermined time, and then control the air conditioner to perform the second heating cycle for the second predetermined time. The first predetermined time and the second predetermined time may be the same time. The controller 8 in case of heating operation may control the air conditioner to perform the first heating cycle and the second heating cycle alternately.

Referring to FIG. 8, the controller 8 in the first heating cycle may close the first valve 48 and open the second valve 49. In the first heating cycle, the first and second fans 13, 23 and the damper 7 are controlled in the same manner as the first cycle.

The controller 8 in the first heating cycle may operate the first gas furnace 15, and stop operation of the second gas furnace 25. Thus, the absorbent 117 on the moisture absorption layer 115 of the first indoor heat exchanger 11 may be heated. In doing so, the absorbent 117 is able to discharge moisture absorbed in the previous cycle (e.g., the second heating cycle) and to be regenerated. Low temperature and dry outdoor air may be humidified and heated while passing through the first indoor heat exchanger 11, and high temperature and humid air may be supplied to indoor room.

Meanwhile, when the outdoor unit 4 is an outdoor unit for both cooling and heating, the controller 8 in the first heating cycle may open the first valve, and control the four-way valve to guide refrigerant discharged from the compressor to the first indoor heat exchanger 11 through the first refrigerant passage 51. In this case, the first indoor heat exchanger 21 may functions as a condenser. Thus, the absorbent 117 on the moisture absorption layer 115 of the first indoor heat exchanger 11 may be heated by refrigerant flowing through the first gas furnace 15 and/or the first indoor heat exchanger 11 in the first heating cycle.

In the first heating cycle, refrigerant discharged from the compressor is guided to the outdoor heat exchanger (and/or the first indoor heat exchanger), and refrigerant passed through the expansion valve is guided to the second indoor heat exchanger 21 through the second refrigerant passage.

Therefore, in the first heating cycle, the second indoor heat exchanger 12 may function as an evaporator. The absorbent 217 on the moisture absorption layer 215 of the second indoor heat exchanger 21 is cooled, so absorbs moisture. High temperature and humid outdoor air discharged from indoor room may be dehumidified and cooled while passing through the second indoor heat exchanger 21, and then low temperature and dry air EA may be discharged to outdoor.

Referring to FIG. 9, the controller 8 in the second heating cycle opens the first valve 48 and closes the second valve 49. In the second heating cycle, the first and second fans 13, 23 and the damper 7 are controlled in the same manner as the second cycle.

In the second heating cycle, the controller 8 may stop operation of the first gas furnace 15 and operate the second gas furnace 25. Thus, the absorbent 217 on the moisture absorption layer 215 of the second indoor heat exchanger 21 may be heated. In doing so, the absorbent 217 may discharge moisture absorbed in the previous cycle (the first heating cycle) and may be regenerated. Low temperature and dry outdoor air OA may be humidified and heated while passing through the second indoor heat exchanger 21, and high temperature and humid air may be supplied to indoor room.

Meanwhile, when the outdoor unit 4 is an outdoor unit for both cooling and heating, the controller 8 in the second heating cycle may open the second valve and control the four-way valve to guide refrigerant discharged from the compressor to the second indoor heat exchanger 21 through the second refrigerant passage 52. In this case, the second indoor heat exchanger 21 may function as a condenser. Thus, in the second heating cycle, the absorbent 217 on the moisture absorption layer 215 of the second indoor heat exchanger 21 may be heated by refrigerant flowing through the second gas furnace 25 and/or the second indoor heat exchanger 21.

In the second heating cycle, refrigerant discharged from the compressor is guided to the outdoor heat exchanger (and/or the second indoor heat exchanger), and refrigerant passed through the expansion valve is guided to the first indoor heat exchanger 11 through the first refrigerant passage 51.

Therefore, the first indoor heat exchanger 11 in the second heating cycle may function as an evaporator. The absorbent 117 on the moisture absorption layer 115 of the first indoor heat exchanger 11 is cooled, so absorbs moisture. High temperature and humid outdoor air discharged from indoor room may be dehumidified and cooled while passing through the first indoor heat exchanger 11, and low temperature and dry air EA may be discharged to outdoor.

Meanwhile, the air conditioner according to an exemplary embodiment of the present disclosure may further include a humidity sensor for detecting humidity in an indoor room and a temperature sensor for detecting temperature in an indoor room. The air conditioner may further include an input section for getting a predetermined temperature from user.

The first predetermined time and the second predetermined time may be in a range from five minutes to 10 minutes.

The first predetermined time and the second predetermined time may be set based on humidity in an indoor room. The controller 8 may compare humidity inputted by the humidity sensor with a reference humidity stored previously, and the greater a difference between the humidity inputted by the humidity sensor and the reference humidity stored previously, the shorter the first and second predetermined time may be set. The reference humidity may be set to a range of 61% to 75% of the relative humidity that the user generally feels comfortable.

The first and second predetermined time may be set based on a temperature in an indoor room and a predetermined temperature inputted from user. The controller 8 may compare a temperature in an indoor room with a predetermined temperature inputted from a user, the greater a difference between temperature in an indoor room and the a predetermined temperature inputted from a user, the larger the first and second predetermined time may be set.

The first predetermined time and second predetermined time may be set based on humidity in an indoor room and a difference between a predetermined temperature inputted from a user and an indoor temperature inputted from the temperature detected by the temperature sensor.

Referring to FIG. 10, the air conditioner according to an exemplary embodiment of the present disclosure may further include first and second indoor units 1, 2 disposed at the other places than an indoor room provided with air-conditioned air and a third indoor unit 3 disposed at the indoor room.

The third indoor unit 3 may be connected to the outdoor unit 4 through a third refrigerant passage 53. The third indoor unit may include a heat exchanger. The heat exchanger may function as an evaporator during cooing operation, and function as a condenser during heating operation.

Although the embodiments of the present disclosure are described above with reference to the accompanying drawings, the present disclosure is not limited to the above embodiments, and may be manufactured in various forms, and in the art to which the present disclosure belongs, those skilled in the art will appreciate that the present disclosure may be embodied in other specific forms without changing the technical spirit or essential features of the present disclosure. Therefore, it should be understood that the embodiments described above are exemplary in all respects and not restrictive.

The invention claimed is:

1. An air conditioner comprising:

an outdoor unit comprising an outdoor heat exchanger;

a first indoor unit comprising a first indoor heat exchanger that is connected to the outdoor unit and includes a moisture absorption layer, the first indoor unit having a first inlet opening and a first outlet opening;

a first intake duct connected to the first inlet opening;

a first air supply duct configured to guide air discharged from the first outlet opening to an indoor room;

a second indoor unit comprising a second indoor heat exchanger that is connected to the outdoor unit and includes a moisture absorption layer, the second indoor unit having a second inlet opening and a second outlet opening;

a second intake duct connected to the second inlet opening;

a second air supply duct configured to guide air discharged from the second outlet of the second indoor unit to the indoor room;

a first refrigerant passage that connects the outdoor unit to the first indoor heat exchanger;

a second refrigerant passage that connects the outdoor unit to the second indoor heat exchanger;

a first valve configured to regulate flow of refrigerant in the first refrigerant passage;

a second valve configured to regulate flow of refrigerant in the second refrigerant passage; and a controller configured to:

based on opening the first valve, close the second valve to block the refrigerant discharged from the outdoor unit from flowing into the second indoor heat exchanger, and based on closing the first valve, open the second valve to allow the refrigerant discharged from the outdoor unit to flow into the second indoor heat exchanger.

2. The air conditioner of claim 1, wherein each of the moisture absorption layers of the first and second indoor heat exchangers is configured to discharge moisture at a temperature higher than a threshold temperature and to absorb moisture at a temperature lower than the threshold temperature.

3. The air conditioner of claim 1, wherein the controller is configured to alternately perform (i) a first cooling cycle for supplying air to the indoor room through the first indoor unit and (ii) a second cooling cycle for supplying air to the indoor room through the second indoor unit.

4. The air conditioner of claim 3, wherein the first indoor unit is configured to, in the second cooling cycle, heat air discharged from the indoor room and discharge the heated air to an outdoor space, and wherein the second indoor unit is configured to, in the first cooling cycle, heat air discharged from the indoor room and discharge the heated air to the outdoor space.

5. The air conditioner of claim 1, wherein the controller is configured to alternately perform (i) a first cooling cycle in which the first indoor heat exchanger defines an evaporator and (ii) a second cooling cycle in which the second indoor heat exchanger defines an evaporator.

6. The air conditioner of claim 5, wherein the controller is configured to:

based on performing the first cooling cycle, open the first valve and close the second valve, and based on performing the second cooling cycle, close the first valve and open the second valve.

7. The air conditioner of claim 5, wherein the first indoor unit further comprises a first gas furnace configured to heat air received into the first indoor unit, wherein the second indoor unit further comprises a second gas furnace configured to heat air received into the second indoor unit, and wherein the controller is configured to:

based on performing the first cooling cycle, stop operation of the first gas furnace and operate the second gas furnace, and based on performing the second cooling cycle, operate the first gas furnace and stop operation of the second gas furnace.

8. The air conditioner of claim 5, wherein the controller is configured to alternately perform the first cooling cycle for a first predetermined time and the second cooling cycle for a second predetermined time.

9. The air conditioner of claim 1, wherein the controller is configured to alternately perform (i) a first heating cycle for supplying air to the indoor room through the first indoor unit and (ii) a second heating cycle for supplying air to the indoor room through the second indoor unit.

10. The air conditioner of claim 9, wherein the first indoor unit is configured to, in the second heating cycle, cool air discharged from the indoor room and discharge the cooled air to an outdoor space, and wherein the second indoor unit is configured to, in the first heating cycle, cool air discharged from the indoor room and discharge the cooled air to the outdoor space.

11. The air conditioner of claim 9, wherein the first indoor unit further comprises a first gas furnace configured to heat air received into the first indoor unit, wherein the second indoor unit further comprises a second gas furnace configured to heat air received into the second indoor unit, and wherein the controller is configured to operate the first gas furnace in the first heating cycle and to operate the second gas furnace in the second heating cycle.

12. The air conditioner of claim 11, wherein the controller is configured to:

based on performing the first heating cycle, close the first valve and open the second valve, and based on performing the second heating cycle, open the first valve and close the second valve.

13. The air conditioner of claim 11, wherein the first indoor heat exchanger is configured to define an evaporator in the second heating cycle, wherein the second indoor heat exchanger is configured to define an evaporator in the first heating cycle, and wherein the controller is configured to stop operation of the second gas furnace in the first heating cycle and to stop operation of the first gas furnace in the second heating cycle.

14. The air conditioner of claim 1, further comprising:

a main intake duct connected to the first intake duct and the second intake duct;

a main exhaust duct that connects the main intake duct to the indoor room, the first intake duct, and the second intake duct; and an intake damper disposed at a position to which the first and second intake ducts, the main intake duct, and the main exhaust duct are connected, wherein the intake damper is configured to:

selectively connect the main intake duct to one of the first intake duct or the second intake duct, and selectively connect the main exhaust duct to the other of the first intake duct or the second intake duct.

15. The air conditioner of claim 14, wherein the controller is configured to control the intake damper, and wherein the controller is configured to alternately perform (i) a first cycle for supplying air to the indoor room through the first indoor unit and (ii) a second cycle for supplying air to the indoor room through the second indoor unit.

16. The air conditioner of claim 15, wherein the controller is configured to:

based on performing the first cycle, control the intake damper to connect the main intake duct to the first intake duct and to connect the main exhaust duct to the second intake duct; and based on performing the second cycle, control the intake damper to connect the main intake duct to the second intake duct and to connect the main exhaust duct to the first intake duct.

17. The air conditioner of claim 1, further comprising:

a first air supply damper disposed at the first air supply duct and configured to open and close the first air supply duct; and a second air supply damper disposed at the second air supply duct and configured to open and close the second air supply duct, wherein the controller is configured to control the first air supply damper and the second air supply damper, and wherein the controller is configured to alternately perform (i) a first cycle for opening the first air supply damper and closing the second air supply damper and (ii) a second cycle for closing the first air supply damper and opening the second air supply damper.

18. The air conditioner of claim 17, further comprising:

a first discharge duct that connects the first outlet opening to the first air supply duct;

a first exhaust duct that connects the first discharge duct to an outdoor space;

a second discharge duct that connects the second outlet opening to the second air supply duct;

a second exhaust duct that connects the second discharge duct to the outdoor space;

a first exhaust damper disposed at the first exhaust duct and configured to open and close the first exhaust duct; and a second exhaust damper disposed at the second exhaust duct and configured to open and close the second exhaust duct, wherein the controller is configured to:

based on performing the first cycle, close the first exhaust damper and open the second exhaust damper, and based on performing the second cycle, open the first exhaust damper and close the second exhaust damper.

19. The air conditioner of claim 1, wherein the first indoor unit further comprises a first gas furnace disposed between the first indoor heat exchanger and the first inlet opening and configured to heat air received into the first indoor unit, and wherein the second indoor unit further comprises a second gas furnace disposed between the second indoor heat exchanger and the second inlet opening and configured to heat air received into the second indoor unit.

* * * * *